US005761765A

United States Patent [19]

Fuzzell

[11] Patent Number: 5,761,765

[45] Date of Patent: Jun. 9, 1998

[54] RUG ANCHOR

[76] Inventor: Joe E. Fuzzell, 1496 Oakmont Pl., Niceville, Fla. 32578

[21] Appl. No.: 757,211

[22] Filed: Nov. 27, 1996

[51] Int. Cl.[6] ..... A47G 27/04

[52] U.S. Cl. ..... 16/8; 16/16

[58] Field of Search ..... 16/4–8, 16, 17.1, 16/10, 13

[56] References Cited

U.S. PATENT DOCUMENTS

| | | | |
|---|---|---|---|
| 2,990,565 | 7/1961 | Atwood | 16/16 |
| 3,047,903 | 8/1962 | Reinhard | 16/16 |
| 3,494,006 | 2/1970 | Brumlik | 16/16 |
| 3,549,471 | 12/1970 | Denton | 16/16 |
| 3,760,454 | 9/1973 | Heinzel et al. | 16/16 |
| 3,858,268 | 1/1975 | Pollack | 16/8 |
| 4,377,610 | 3/1983 | McClung | 428/88 |
| 4,581,269 | 4/1986 | Tilman | 16/16 |

FOREIGN PATENT DOCUMENTS

| | | | |
|---|---|---|---|
| 1511872 | 5/1978 | United Kingdom | 16/6 |
| 1523725 | 9/1978 | United Kingdom | 16/6 |

*Primary Examiner*—Chuck Mah

[57] ABSTRACT

An anchoring device that securely attaches a carpet runner to an underlying carpet that is inexpensive to manufacture, easy to install, does not create a raised area to cause one to trip and fall or create a wear spot in the carpet runner or carpet, and can be easily removed without damage to the carpet runner or the underlying carpet.

1 Claim, 3 Drawing Sheets

RUG ANCHOR

BACKGROUND—FIELD OF INVENTION

This invention relates to anchoring a carpet runner to the top surface of a carpet.

BACKGROUND—DESCRIPTION OF THE PRIOR ART

A carpet runner typically consisting of a long rectangular piece of carpeting placed on top of an existing carpet to cover areas that are subject to heavy traffic, thereby preventing wear in the more expensive piece of carpeting. When the carpet runner is simply placed on top of the carpeting without a retaining device, it will creep or move relative to the surface upon which it is placed. It's appearance is unsightly, and because of it's uneven surface can cause a person to trip and fall causing serious injury. An additional disadvantage of an un anchored carpet runner, is the constant source of annoyance due to the necessity to constantly reposition the carpet runner.

Currently a popular method to prevent creepage that is not 100% effective, is a mat in a waffle or other suitable configuration placed between the carpet runner and carpet. This method depends upon a person's weight to produce friction between the carpet runner, mat and carpet to resist creepage, but due to the carpet runner being raised by the thickness of the mat, the toe or heel of one's shoe is prone to catch and displace the carpet runner, or cause one to trip and fall U.S. Pat. No. 3,858,268, to Pollak (1975) discloses a method to prevent creepage utilizing a mechanism containing coil springs assembled between the carpet runner and carpet. These coil springs will create unsightly bulges in the runner that will induce wear in both the runner and carpet when walked on, and the mechanism will be costly and difficult to install.

Other U.S. Pat. No. 2,990,565 to Atwood (1959), 3,047,903 to Reinhard, 3,494,006 (1959), and Great Britain patents 1,523,725 to Cooper (1978), 1,511,872 to Hearn (1978) and 3,549,471 to Denton (1970), concentrate primarily on improving the method of fastening the edge of a carpet to the floor where it meets the base board and wall Additional U.S. Pat. Nos. 3,760,454 to Heinzel et al., and 4,581,269 to Tilman, are dedicated to carpet seaming mechanisms.

Objects and Advantages

The following are objects and advantages of my invention:

(a) To provide a positive means for anchoring a carpet runner to a underlying carpet that does not elevate the carpet runner, thereby lessening the chance of one tripping and falling over the carpet runner's edges.

(b) to provide a positive means for anchoring a carpet runner to a underlying carpet that is easy to install and, does not contain components that will cause wear in carpet runner or carpet.

DRAWING FIGURES

DESCRIPTION OF PREFERRED EMBODIMENTS

Figure 1:
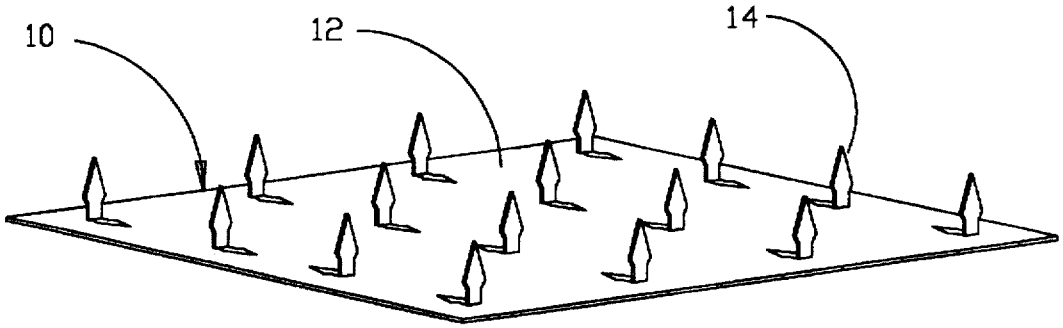
FIG. 1 shows a three dimensional view comprising of one half of the carpet runner anchoring device.
Figure 2:
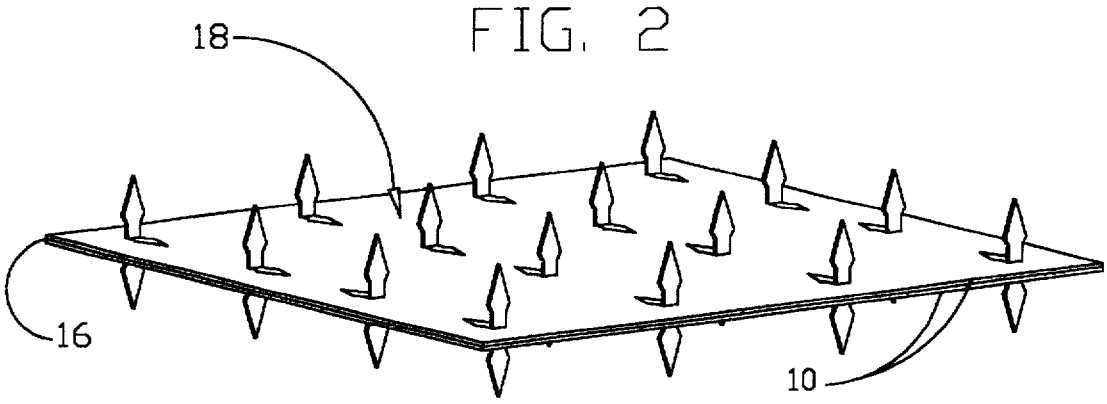
FIG. 2 shows a three dimensional view of an assembly consisting of two of the parts shown in FIG. 1, assembled back to back to form a completed carpet runner anchoring device.
Figure 3:
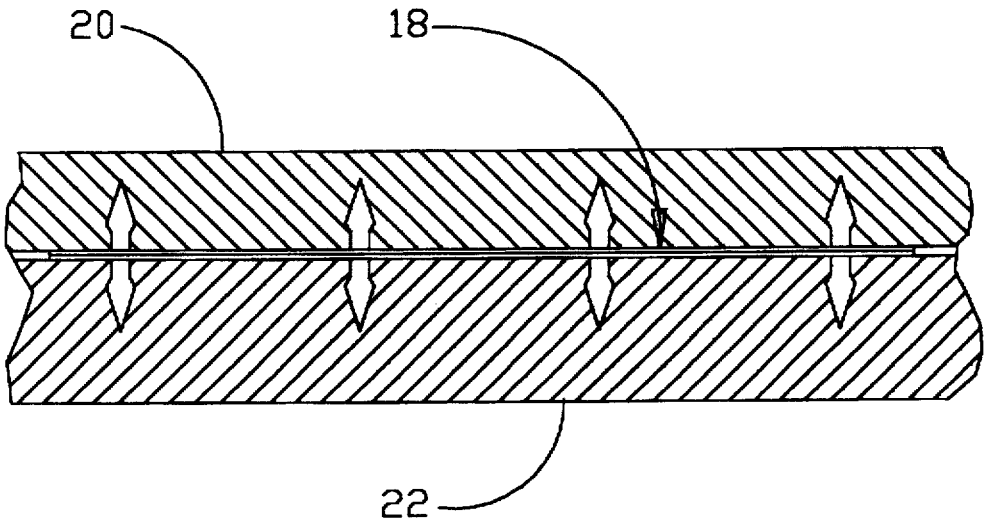
FIG. 3 shows a cross sectional view of a carpet runner anchoring device in an assembled position between a carpet runner and a carpet.

A typical embodiment of the anchoring device is illustrated in FIG. 1, where reference number 10 represents one half of an anchoring device, and comprises a metal plate 12 of suitable shape and thickness with a plurality of fingers 14 extruded to a position perpendicular to the top side of metal plate 12, having a shape and length suitable for engaging the underside of the carpet runner and top surface of the carpet with an extraction force sufficient to stay engaged under normal use, FIG. 2, illustrates a completed assembly of the anchoring device 18 containing two rug anchor element 10 assembled back to back with double back adhesive tape 16, and FIG. 3 is a sectional view illustrating an anchoring device 18 assembled between a carpet runner 20 and a carpet 22.

Summary The present invention is directed toward providing a means to prevent a carpet runner from moving relative to a carpet upon which it is placed, that is inexpensive and easy to install. The present invention is also directed toward overcoming the undesirable aspects of the Pollak invention listed under prior art, such as the springs that produce protrusions in the carpet runner and carpet that are unsightly, and cause localized wear in the runner and carpet and is difficult to install, and the uneven surface of the runner caused by the springs will also present a safety hazard.

I claim:

1. An anchoring device for appending a carpet runner to a carpet, said device will prevent relative movement between the carpet runner and the carpet and will not cause wear at the installed location, said device comprising:

a first sheet and a second sheet of rigid material of suitable shape, size, and thickness, each of said sheets having a top side and a bottom side, each top side of the sheets having a plurality of fingers of suitable shape extending therefrom;

a double back adhesive tape;

said bottom sides of the sheets being attached together via said double back adhesive tape such that the fingers on the first sheet and the second sheet are pointing in opposite directions, thereby forming an anchoring device.

* * * * *